United States Patent [19]

Varona

[11] 4,309,469

[45] Jan. 5, 1982

[54] FLUSHABLE BINDER SYSTEM FOR PRE-MOISTENED WIPERS WHEREIN AN ADHESIVE FOR THE FIBERS OF THE WIPERS INTERACTS WITH IONS CONTAINED IN THE LOTION WITH WHICH THE WIPERS ARE IMPREGNATED

[75] Inventor: Eugenio G. Varona, Secane, Pa.

[73] Assignee: Scott Paper Company, Philadelphia, Pa.

[21] Appl. No.: 29,613

[22] Filed: Apr. 13, 1979

Related U.S. Application Data

[63] Continuation of Ser. No. 826,726, Aug. 22, 1977, abandoned.

[51] Int. Cl.[3] ..... B32B 7/10; B32B 23/08; B32B 23/14

[52] U.S. Cl. ..... 428/74; 15/104.93; 15/209 R; 206/205; 206/812; 428/76; 428/288; 428/290; 428/913

[58] Field of Search ..... 206/205, 812; 15/104.93, 209 R; 428/913, 288, 290, 74, 76

[56] References Cited

U.S. PATENT DOCUMENTS 3,808,165 4/1974 Dushane .
3,846,158 11/1974 Vasilyadis .
4,117,187 9/1978 Adams et al. ..... 428/288

*Primary Examiner*—James C. Cannon
*Attorney, Agent, or Firm*—John A. Weygandt; John W. Kane, Jr.

[57] ABSTRACT

A three component adhesive is used for a nonwoven web in combination with a water based lotion containing borate ions. The adhesively bonded web has substantial tensile strength while saturated with the lotion for extended periods of time (e.g., months) and is water dispersible when exposed to a large volume of water. The three component adhesive system provides the tensile strength for the web during prolonged exposure to the water based lotion even under extreme temperature conditions. The components of the adhesive composition applied to the web are polyvinyl alcohol, a non-self-cross-linking, thermosetting, polymer emulsion and a self-cross-linking thermosetting polymer emulsion. An organic acid capable of complexing with borate, such as α-hydroxy acids or o-aromatic hydroxy acids, when in combination with borate ions in the lotion produces a synergistic effect upon the PVA adhesive in the web.

21 Claims, No Drawings

FLUSHABLE BINDER SYSTEM FOR PRE-MOISTENED WIPERS WHEREIN AN ADHESIVE FOR THE FIBERS OF THE WIPERS INTERACTS WITH IONS CONTAINED IN THE LOTION WITH WHICH THE WIPERS ARE IMPREGNATED

This is a continuation, of application Ser. No. 826,726, filed Aug. 22, 1977, now abandoned.

BACKGROUND OF THE INVENTION

1. Field of the Invention

The present invention concerns adhesively bonded, nonwoven webs having a majority of papermaking fibers and pre-moistened wipers comprising the web, a three component mixed polymer adhesive for the fibers of the web and a water base lotion containing borate ions for pre-moistening the web. α-hydroxy acids, o-aromatic hydroxy acids and keto acids are included in the lotion in one embodiment of the invention to achieve a synergistic effect.

2. Description of the Prior Art

Flushable non-woven webs and fibrous batts have been made having temporary wet strength. Two basic approaches have been taken to obtain temporary wet strength. One approach employs a polyvinyl alcohol gelled with borate ions which gel breaks down in the presence of a large volume of water but retains strength temporarily in the presence of limited quantities of liquid, see for example U.S. Pat. Nos. 3,645,928; 3,692,725 and 3,808,165 all issued to D. Duchane. A second method to obtain temporary wet strength is to blend a water insensitive polymer with a water soluble material. The water insoluble material retards the effect of water and the water soluble material provides cites for the water to slowly break down the adhesive and cause the web to disintegrate, see for example U.S. Pat. No. 3,554,788 entitled WATER DISPERSIBLE NON-WOVEN FABRIC. Such prior art methods usually rely upon the presence of textile length fibers in the web to impart wet strength due to long fiber length which causes entangling and roping of the fibers. A multi-layer approach to obtaining a pre-moistened, flushable wiper is disclosed in U.S. Pat. No. 3,881,210 which has a water dispersible, thermoplastic reinforcing layer. Fiber adhesives that are attached by specific enzymes to obtain dispersibility is disclosed in U.S. Pat. No. 4,009,313.

The prior art methods of obtaining temporary wet strength for a web are deficient with respect to maintaining wet strength over prolonged periods of time, (e.g., months) while wet with a water based lotion and subjected to extreme environmental conditions that can be encountered during shipment of commercial products and still be dispersible after use. Prior art methods either lost their wet strength during prolonged contact with the water base lotion or lost their ability to disperse when immersed in large quantities of water after being exposed to elevated temperatures, e.g., 140° F. Furthermore, those systems which relied only upon the interaction of polyvinyl alcohol and a borate ion in the lotion required high concentrations of borate ions which is objectionable for lotions designed for cleansing human skin.

SUMMARY OF THE INVENTION

A nonwoven, adhesively bonded web containing a majority of papermaking fibers is impregnated with a water based lotion, said web having a tensile strength of at least 4 oz/in in at least one direction while wet with the water based lotion for prolonged periods and substantially losing the wet tensile strength when immersed in a volume of water at least ten times the weight of the web. The wet tensile strength is imparted to the web by an adhesive composition which obtains at least part of its adhesive properties by interaction with said lotion, said adhesive composition, as applied to the web, contains from about 5 to about 15 parts polyvinyl alcohol, from about 1.5 to about 2.5 parts of a non-self-cross-linking, thermosetting, water dispersible polymer emulsion, and from about 0.75 to about 1.25 parts of a water dispersible, self-cross-linking, thermosetting polymer emulsion, said water based lotion containing an active amount of borate along with desired lotion ingredients such as a fragrance, soap, or a preservative and adjusted to a pH in a range of about 8 to 10. In addition, a nonwoven web, adhesively bonded with polyvinyl alcohol has a synergistic improvement in its wet strength and dispersibility when an organic acid of the type capable of complexing with borate is included in the lotion along with borate ions.

DETAILED DESCRIPTION OF THE INVENTION

The web component of the impregnated wiper contains a majority of short fibers and is a dry formed web or a non-wet strengthened, wet lay paper web.

Dry-formed webs are a class of non-woven materials produced by processes other than the classical wet-lay papermaking process of slurring fibers in water and then forming the web by depositing the fibers on a foraminous surface through which the water passes. Dry-forming processes do not employ a water and fiber slurry and accordingly they are referred to as "dry" formed although moisture may be present during the forming process. Typical dry-formed, nonwoven webs suitable for the present invention are air laid webs and carded webs provided they are produced from a majority of papermaking length fibers (minor quantities of textile length fibers can be admixed therewith). The fibers are usually wood pulp fibers although cotton linters and synthetic fibers such as rayon, polyester and mixtures thereof are suitable, provided a majority of the web fibers are of papermaking length or shorter (average length of $\frac{3}{8}$ inches or less for the papermaking fibers). The fibers are dispersed in a gaseous fluid and deposited upon a foraminous surface to form the web. Apparatus for forming such webs are usually referred to as dry web formers and are available commercially under such product names as RANDO-FEEDER and RANDO-WEBBER.

The dry formed web must be adhesively bonded to give the web structural integrity and wet tensile strength. The adhesively treated web is dried to cure the adhesive. Sometimes moisture is added in minor quantities at various points in the production process but the webs are still referred to in the art as "dry-formed". Without the adhesive, the web would have little or no wet strength.

Specific examples of dry-formed webs and methods by which they are produced are contained in U.S. Pat. No. 3,862,472, issued to Norton et al, British Pat. No. 1,311,619 and British Pat. No. 1,246,910, which patents are incorporated herein with respect to their disclosure of dry-formed webs and their method of production.

Wet lay paper webs are suitable for use in the present invention provided they do not contain conventional wet strength resins in sufficient quantity to give the web a wet tensile strength in any direction of greater than about 4 ounces per inch. Such a wet laid paper web is referred to herein as a non-wet-strengthened paper web. Such non-wet-strengthened paper webs when strengthened with the adhesive composition of the present invention and wet with the lotion will have a tensile strength of greater than 4 oz./in. in at least one direction but still be dispersible in water.

Generally, the preferred webs for practicing the present invention are produced from wood pulp fibers mixed with synthetic fibers (e.g., rayon) which fibers are suspended in air and deposited on a foraminous member to form an unbonded, low density mat (web) which is subsequently adhesively bonded and embossed with or without moisture followed by drying and curing of the adhesive.

A particularly preferred web is of the type sold by Scott Paper Company under the tradename Shop-Towel® which is a dry-formed web made from about 80% wood pulp (⅜" or shorter) and about 20% synthetic fibers (about 1.5" long), having a basis weight in the range of about 20 to about 110 lbs./ream but containing an adhesive composition of the type defined hereafter.

WEB ADHESIVE

The fibers of the web are bound together with an adhesive composition to give the web strength and structural integrity. At least about 1% adhesive is added to the web based upon the weight of polymer solids in the adhesive and the weight of air dry fibers in the web. Preferably from about 4% to about 20% adhesive is added to the web with 12% particularly preferred. Conventional methods of applying adhesives to dry-formed webs are suitable for use in the present invention including such methods as spraying the adhesive composition onto the formed web, foaming the adhesive composition and spreading the adhesive foam over the web, and printing the adhesive composition onto the web in a continuous or discontinuous printed pattern of discrete areas of adhesive composition by well known methods such as gravure roll printing.

Since the dispersibility property of the web does not require any particular adhesive distribution pattern, it is not necessary for any particular pattern to be used. Preferably, the adhesive is applied uniformly across both surfaces of the web and penetrates into the web to effectively bond the fibers into a web. Because the majority of the fibers are of a papermaking length (average length), the web strength of the web is essentially due to the adhesive bonds.

ADHESIVE COMPOSITION

The main inventive concept of the present invention concerns the use of three critical components in the adhesive composition within specified proportions for each component in combination with a water based lotion having an alkaline pH and containing borate ions. The adhesive composition as applied to the web comprises three components:

1. Component 1 is a cold water soluble, medium to high molecular weight, partially hydrolyzed (70% to 90% hydrolyzed) polyvinyl alcohol (PVA). The molecular weight of the PVA, expressed as the degree of polymerization (D.P.), should be at least 450 and preferably in the range of from about 450 to about 2,500. Such partially hydrolyzed, medium to high molecular weight PVA is readily available commercially and well-known to those familiar with adhesives. The PVA is the major component of the adhesive composition and comprises from about 5 to about 15 parts of the adhesive composition. With respect to the adhesive composition, parts are by weight based upon the total weight of polymer solids in the adhesive compositions (water portion not included).

About 8 parts PVA is preferred for 78% hydrolyzed PVA while about 15 parts is preferred for about 90% hydrolyzed PVA. Neither 60% hydrolyzed PVA nor 99% hydrolyzed PVA will disperse (solubilize) in cold water and accordingly are outside the scope of the present invention.

2. Component 2 is a non-self-cross-linking, water dispersable, thermosetting polymer emulsion capable of functioning as a fiber adhesive, having a molecular weight of at least about 100,000 and being a film forming polymer having a glass transition temperature in the range of from about −50° C. to about +45° C. (temperature at which the torsional modulus of an air dried film of polymer solids is 300 kg./cm.$^2$). The preferred range is −46° C. to +33° C. "Non-self-cross-linking" means a polymer without a suitable cross-linking moiety in the polymer chain for cross-linking with an adjacent polymer chain either directly or through with a cross-linking agent. Such polymers are usually referred to in the industry as non-cross-linking or cross-linkable but not as self-cross-linking. Such polymers are usually polyacrylic or polyvinyl polymers or copolymers thereof. Water dispersible means the polymer is water insoluble but dispersible to form an emulsion in water sometimes with the aid of an emulsifier (a surfactant). RHOPLEX® is a series of suitable non-ionic and cationic polymer emulsions available from Rohm and Haas Company, many which are non-self-cross-linking. Particularly preferred is RHOPLEX® HA-4 a cross-linkable but not self-cross-linking, non-ionic, acrylic polymer emulsion having a first order glass transition temperature ($T_{300}$) of −17° C. and a viscosity at 25° C. (No. 3, spindle 60 r.p.m. for a 45% solids emulsion tested on a Brookfield Viscometer) of about 200 CPS. In addition to acrylic polymers, suitable polymers include vinyl, nitrile and styrene butadiene polymers and copolymers thereof such as ethylene vinyl acetate available commercially from Dupont as ELVACE 1961. Typical cross-linkable but not self-cross-linking polymers in the RHOPLEX series include acrylic polymers known as RHOPLEX B-15 ($T_{300}$=−4° C.) and RHOPLEX B-10 ($T_{300}$=−7° C.). Component 2 comprises from 1.5 to 2.5 parts of the adhesive composition as applied to the web.

3. Component 3 is a water dispersible, self-cross-linking polymer the same as component 2 except having incorporated in the polymer reactive sites which make the polymer self-cross-linking. Typical reactive sites include the carboxyl or N-methylol amine functional group. Suitable polymers are those having a molecular weight greater than about 100,000 and a first order glass transition temperature (temperature at which the torsional modulus of an air-dried film of the polymer solids is 300 kg./cm.$^2$) in the range of −50° C. to +45° C. and preferably in the range of −22° C. to +33.° C.

Typical self-cross-linking polymer emulsions suitable for the present invention include acrylic, nitrile, vinyl and styrene butadiene polymers and copolymers thereof. Suitable self-cross-linking polymer emulsions are available commercially from such companies as Rohm and Haas Company which makes a series of self-cross-linking acrylic polymers under tradenames such as RHOPLEX HA-16 ($T_{300}$ of +33° C.), HA-8 ($T_{300}$ of −14° C.) and TR-520 ($T_{300}$ of −8° C.). An ethylene vinylacetate self-cross-linking polymer emulsion is available commercially from Air Products Company under the tradename A-120 ($T_{300}$ of −20° C.).

A catalyst is usually included along with the self-cross-linking polymer in accordance with the manufacturer's directions. Preferably about 0.2%–0.4% ammonium chloride (based on total weight of adhesive formulation) is added as a catalyst for the self-cross-linking emulsion polymer.

A mixture of the PVA, the water based emulsion of the self-cross-linking polymer and the water based emulsion of the non-self-cross-linking polymer are applied to the web as the adhesive composition. After the adhesive composition is applied to the web, the adhesive is cured usually by heating the web. A temperature of from about 275° F. to about 350° F. is preferred which drives off the water associated with the polymer emulsion and cures the polymers to enhance their effectiveness as a fiber adhesive.

LOTION

The adhesively bonded and cured web is wet (usually saturated) with the lotion. The lotion is a water solution containing borate ions (usually obtained from boric acid although other equivalent sources of borate ions could be used such as sodium borate). The lotion should contain an active amount of borate ions sufficient to form a gel with the polyvinyl alcohol and impart wet strength to the web. Said active amount is normally present in a solution of at least 0.5% boric acid at a pH of in the range of about 8.0 to 10.0. A lotion containing 0.5% to 1.5% boric acid is preferred.

The pH of the water lotion preferably is adjusted to the alkaline side. A pH in the range of from 8 to 9 is particularly suitable especially when buffered with a suitable buffer such as triethanolamine. Preferably the web is packaged wet with from about 100% to about 600% lotion based upon the air dry weight of the web to obtain a suitable pre-moistened wiper having significant wet strength.

The PVA component of the adhesive composition interacts with the borate ions in the lotion to produce a water-resistent gel thereby strengthening the web while wet with the borate containing lotion. The interaction is synergistically improved with ions of an organic hydroxy acid or a keto acid capable of complexing with borate ions.

CITRATE CONTAINING LOTION

A compound capable of complexing with the borate ion in the water based lotion significantly increases the effectiveness of the lotion. The complex forms a gel with the PVA to strengthen the web and allows the PVA gel to retain its dispersibility. An organic hydroxy acid or keto acid or salts thereof such as sodium, potassium, lithium, ammonium and magnesium salts are suitable. α-hydroxy aliphatic acids, o-aromatic hydroxy acids, alicyclic αhydroxy acids and keto acids are generally suitable for forming a complex with borate ions. The ability of an organic acid or its salt to form a complex with borate ions is indicated by an incremental increase in the conductivity of a boric acid solution in the presence of the organic acid or its salt. An "incremental increase in conductivity" is an increase in the observed conductivity of the organic acid (or salt) and boric acid solution minus the sum of the conductivities of the individual organic acid (or salt) and boric acid solutions. Particularly suitable are salts of α or o-hydroxy carboxylic acids, especially α-hydroxy dibasic acids. Sodium, potassium tartrate, potassium citrate, and lactate and salicylate salts are quite suitable with potassium citrate being the most preferred. A listing of suitable α-hydroxy acids, o-aromatic hydroxy acids, keto acids and alicyclic α-hydroxy acids capable of increasing the conductivity of a boric acid solution is contained in Organoboron Chemistry, Volume 1, Howard Steinberg, Interscience Publishers, 1964 in Table 16-2 beginning at page 748. The sodium, potassium, lithium, ammonium and magnesium salts of such acids are particularly suitable for use in the lotion of the present invention in conjunction with borate ions. Table 16-2 of the Organoboron Chemistry text shows α-hydroxy acids having 2 to 8 carbon atoms; o-aromatic hydroxy acids having 7 to 11 carbon atoms; alicyclic α-hydroxy acids having 4 to 8 carbon atoms; and keto acids having 3 to 10 carbon atoms as being suitable.

The molar ratio of borate species in solution to the compound capable of complexing with borate should be from 0.1:1 to 1.6:1 with 0.5:1 preferred. For the purpose of this ratio, the dissociated compound (ions) in the lotion solution are considered equivalent to undissociated compound. A web having an adhesive of only PVA retains the ability to disperse while packaged for prolong periods in a lotion containing borate ions and a compound capable of forming a complex with borate ions derived as defined above. However, the three component adhesive is preferred for its ability to withstand elevated temperatures.

The following example shows the functionality of the present invention in that an adhesive formulation has been achieved which imparts substantial wet strength to a web during prolonged contact with a water based lotion even in extreme environments, but which web is dispersible as tested because the wet strength of the web substantially decreases when the web is exposed to a large volume of water. All percentages and parts given herein are based on weight unless indicated otherwise.

EXAMPLE

Many samples of a dry-formed, air-lay web having about 85% wood pulp fibers and about 15% synthetic fibers (rayon fibers) was formed on a foraminous surface and adhesively bonded by spraying 12% of an adhesive onto the web and subsequently curing the adhesive by subjecting the web to a temperature of about 325° C. for a period of about 4 minutes. The air-laid, adhesively bonded and cured web was then sealed in a package containing a water based lotion which wets the web with about 250% lotion based upon the weight of the web. The sealed package was then stored for various lengths of time at 75° F. or 145° F. before being opened and the web tested for its dispersability. The dispersability of the web was tested in an apparatus comprising a cylindrical container 8½ inches in diameter and 9¾ inches high, having a domed shaped agitator centered axially in the container and located a small distance above the bottom. To test the dispersibility of a web, the container was filled with 4 liters of water, maintained at a temperature of between 15° C. to 20° C. and the agitator rotated at 650 r.p.m. which produced a vortex in the water. A sample piece of web (5 inches by 5 inches) is immersed into the agitated water and kept out of the vortex formed in the center. The time required for the sheet to break up into about 1 inch square pieces is observed and recorded as the dispersal time. The test is stopped after 2000 seconds if the sheet did not disperse by then. Such a sheet is characterized as being non-dispersible and given a rating of 2000+ seconds.

Using the above procedure, twenty-six samples of the web was adhesively bonded with an adhesive composition as indicated in Table I (ammonium chloride was the catalyst). After the adhesive was cured, the web was packaged wet with a water based lotion containing borate ions and/or other ingredients as indicated in Table I. The packaged, lotion impregnated wiper was then tested for the effect of storage for various periods of time at ambient and elevated temperature by removing a sample of the impregnated wiper from the package and testing it for tensile strength while wet with the lotion and for dispersibility after each of the storage tests. Whether the web retained wet strength and dispersibility is indicated in Table I as yes or no while Table II gives the detailed results of the wet strength and dispersibility tests.

Table II gives the wet tensile strength of the web and the dispersibility time (seconds) for the samples. The columns in Table II under the heading "Dispersibility, Time" indicate the dispersibility of the web after various periods of aging in the package with the lotion. The column headed "145° F." gives the results of a dispersibility test after the package was held at 145° F. for five or seven days as indicated. Likewise, the columns headed "Wet Strength, Time" gives the wet tensile strength in ounces/inch of the web while still wet with the lotion after the storage test (e.g., 16.5 means the web had a wet tensile of 16.5 oz./in. while still wet with the lotion after the storage test).

SIGNIFICANCE

The tables show that the combination of three critical ingredients in the adhesive formulation in combination with the presence of borate ions in the lotion is an effective adhesive for a nonwoven fibrous web of wood pulp fibers. The adhesive retains its dual functionality of providing wet tensile strength during prolonged exposure to a water lotion even after high temperature storage and still loses its wet strength to enable the web to disperse when exposed to large volumes of water without an activating amount of borate ions. A polyvinyl alcohol and borate system by itself does not retain this dual functionality over the typical exposure time of the web in the water lotion and the storage conditions to be encountered in transit of such products. Likewise, a self-cross-linking latex even in combination with a non-self-cross-linking latex does not provide this dual functionality.

The tables also show a synergistic effect upon the polyvinyl alcohol component of the adhesive (component 1). The synergistic effect is obtained with a combination of borate ions and a compound capable of forming a complex with borate ions.

TABLE I

| Sample No. | Adhesive % Added to Web | Adhesive Components #1 Parts | #1 Hydro. | #2 Parts | #2 Type | #3 Parts | #3 Type | Lotion Cat. | pH | Boric Acid % | Citrate | Dispersibility & Wet Strength Time | Time & Temp. |
|---|---|---|---|---|---|---|---|---|---|---|---|---|---|
| 1 | 11 | 3 | 88 | 0.4 | HA-4 | 0.2 | HA-8 | 0.2 | 8.5 | 0.8 | 2.0 | Yes | Yes |
| 2 | 11 | 3 | 88 | 0.4 | HA-4 | 0.2 | A-120 | 0.2 | 8.5 | 0.8 | 2.0 | Yes | Yes |
| 3 | 11 | 3 | 78 | 0.75 | HA-4 | 0.38 | A-120 | 0.4 | 8.5 | 0.8 | 2.0 | Yes | Yes |
| 4 | 11 | 3 | 88 | 0.4 | HA-4 | 0.2 | TR-520 | 0.2 | 8.5 | 0.8 | 1.0 | Yes | Yes |
| 5 | 11 | 3 | 88 | 0.4 | B-15 | 0.2 | HA-8 | 0.2 | 8.5 | 0.8 | 1.0 | Yes | Yes |
| 6 | 11 | 3 | 88 | 0.4 | B-15 | 0.2 | TR-520 | 0.2 | 8.5 | 0.8 | 1.0 | Yes | Yes |
| 7 | 11 | 3 | 78 | 0.75 | E1*** | 0.38 | A-120 | 0.4 | 8.5 | 0.2 | 2.0 | Yes | Yes |
| 8 | 11 | 3 | 88 | 0.4 | HA-4 | 0.2 | A-120 | 0.2 | 9.2 | 1.0 | — | Yes | Yes |
| 9 | 11 | 3 | 78 | 0.75 | HA-4 | 0.38 | A-120 | 0.4 | 8.5 | 0.8* | 2.0 | Yes | Yes |
| A | 12 | N/A | 88 | | | | | | 8.5 | 0.8* | 2.0 | Yes | No |
| B | 12 | N/A | 88 | — | — | — | — | — | 8.5 | 1.0 | 1.0 | Yes | No |
| C | 12 | N/A | 88 | — | — | — | — | — | 9.2 | 1.0* | — | No | No |
| D | 12 | N/A | 88 | — | — | — | — | — | 8.3 | 1.0 | — | No | No |
| E | 12 | N/A | 88 | — | — | — | — | — | 6.3 | 1.0 | | No | — |
| F | 12 | N/A | 88 | — | — | — | — | — | 6.0 | 3.0 | | Yes | No |
| G | 12 | | — | N/A | HA-4 | — | — | — | 8.5 | 0.8 | 2.0 | No | — |
| H | 4 | | — | N/A | HA-4 | — | — | — | 8.5 | 0.8 | 2.0 | No | — |
| I | 12 | | — | N/A | HA-4 | — | — | — | 8.5 | 0.8 | 2.0 | No | — |
| J | 1 | | — | | — | 1.0 | A-120 | 0.2 | 8.5 | 0.8 | 2.0 | No | — |
| K | 4 | | — | | — | 4.0 | A-120 | 0.2 | 8.5 | 0.8 | 2.0 | No | — |
| L | 12 | 3 | 88 | 0.4 | HA-4 | — | — | — | 8.5 | 0.8 | 2.0 | No | No |
| M | 12 | — | — | 2.0 | HA-4 | 1.0 | A-120 | 0.2 | 8.5 | 0.8 | 2.0 | No | — |
| 10 | 12 | N/A | 88 | — | — | — | — | | 8.5 | 1.0 | 1.0 | Yes | No |
| N | 12 | N/A | 88 | — | — | — | — | | 8.3 | 1.0 | — | No | No |
| O | 12 | N/A | 88 | — | — | — | — | | 8.5 | — | 1.0 | No | — |
| 11 | 12 | | 88 | — | — | — | — | | 8.5 | 1.0 | 1.0** | Yes | — |
| 12 | 12 | | 88 | — | — | — | — | | 8.5 | 1.0 | 2.0** | Yes | — |

*Borax instead of Boric acid as source of borate ions.
**K, Na Tartrate instead of K citrate.
***ELVACE®

TABLE II

| Sample # | Dispersibility Weeks at 75° F. 0 | 1 | 4 | 12 | 5 Days at 145° F. | Strength, Wet with Lotion Weeks at 75° F. 0 | 1 | 4 | 12 | 5 Days at 145° F. |
|---|---|---|---|---|---|---|---|---|---|---|
| 1 | 190 | 225 | 240 | 250 | 165 | 17.1 | 16.9 | 17.4 | 16.8 | 14.3 |
| 2 | 300 | 375 | 350 | 370 | 200 | 20.2 | 20.6 | 19.8 | 18.3 | 18.2* |

TABLE II-continued

| Sample | Dispersibility | | | | | Strength, Wet with Lotion | | | | |
|---|---|---|---|---|---|---|---|---|---|---|
| | Weeks at 75° F. | | | | 5 Days | Weeks at 75° F. | | | | 5 Days |
| # | 0 | 1 | 4 | 12 | at 145° F. | 0 | 1 | 4 | 12 | at 145° F. |
| 3 | 370 | 350 | 330 | 370 | 150* | 19.9 | 19.7 | 20.9 | 19.8 | 17.1 |
| 4 | 270 | 350 | 320 | — | 135 | 21.4 | 17.6 | 21.5 | — | 20.8 |
| 5 | 120 | 200 | 220 | — | 150 | 15.3 | 17.9 | 21.0 | — | 15.9 |
| 6 | 320 | — | 200 | — | 200 | 19.5 | — | 19.1 | — | 14.0 |
| 7 | 253 | — | 360 | — | 170 | 23.7 | — | 20.8 | — | 17.5 |
| 8 | 825 | 2000+ | — | — | 90 | 20.2 | 21.8 | — | — | 17.1 |
| 9 | 570 | — | — | — | 70* | 22.9 | — | — | — | 9.7* |
| A | 350 | 290 | 370 | | 60* | 15.3 | 13.2 | 13.2 | — | 3.5* |
| B | 550 | 600 | 550 | 400 | 60* | 19.2 | 12.9 | 15.1 | 15.0 | 3.5* |
| C | 980 | 2000 | 2000+ | — | 60* | 16.3 | 12.8 | 13.9 | — | 3.7* |
| D | 800 | 2000+ | 2000+ | | 60* | 15.8 | 11.1 | 15.7 | — | 3.5* |
| E | 200 | — | — | — | — | 3.5 | — | — | — | — |
| F | 370 | 350 | 380 | — | 55* | 13.4 | 11.0 | 12.2 | — | 2.7* |
| G | 200 | — | — | — | — | 0.9 | — | — | — | — |
| H | 300 | — | — | — | — | 0.9 | — | — | — | — |
| I | 450 | — | — | — | — | 1.0 | — | — | — | — |
| J | 1000 | — | — | — | — | 1.3 | — | — | — | — |
| K | 2000+ | — | — | — | — | 4.0 | — | — | — | — |
| L | 250 | 175 | — | — | — | 21.8 | 5.4 | — | — | 1.7* |
| M | 2000+ | — | — | — | — | 6.9 | — | — | — | — |
| 10 | 550 | 600 | 550 | 400 | 60* | 19.2 | 12.9 | 15.1 | 15.0 | 3.5* |
| N | 800 | 2000+ | 2000+ | — | 60* | 15.8 | 11.1 | 15.7 | — | 3.5* |
| O | 140 | — | — | — | — | 1.5 | — | — | — | — |
| 11 | 318 | 300 | 320 | — | — | 18.0 | 14.0 | 14.2 | — | — |
| 12 | 250 | 240 | 250 | — | — | 18.1 | 13.7 | 14.5 | — | — |

*7 days instead of 5 days.

I claim:

1. A nonwoven, adhesively bonded web having a majority of wood pulp fibers of a papermaking length:

said web wet with a water based lotion, having a tensile strength of at least 4 oz./in. while wet with the lotion, maintaining said tensile strength while wet with the lotion for a period of at least one month and substantially losing the wet tensile strength when immersed in a volume of water at least 10 times the weight of the web, said wet tensile strength being obtained with a cold water soluble polyvinyl alcohol adhesive having a degree of hydrolysis of from about 70% to about 90% and a degree of polymerization of at least 450;

said lotion being a water solution containing borate ions and a compound capable of forming a complex with the borate ions, wherein the amount of borate ions and complexes thereof is sufficient for forming a gel with the polyvinyl alcohol adhesive to impart a wet tensile strength to the web of at least 4 oz./in.

2. The lotion and wet web combination of claim 1 wherein the web has from about 4% to about 20% polyvinyl alcohol adhesive based upon the air-dry weight of the web and is contained in a package containing from about 100% to about 600% lotion based upon the air-dry weight of the web, said lotion containing a concentration of borate ions equivalent to a solution containing 0.5% to 1.5% boric acid at a pH in the range of from about 8.0 to 10.0, and said lotion containing a compound capable of forming a complex with borate ions; and the molar ratio of borate species in solution to the complex forming compound in said lotion being from 0.1:1 to 1.6:1.

3. The lotion and wet wet combination of claim 1 wherein the compound capable of complexing with borate is an α-hydroxy organic acid or a salt thereof.

4. The lotion and wet web combination of claim 3 wherein the α-hydroxy acid or salt thereof is citric acid or potassium citrate.

5. The lotion and wet web combination of claim 1 wherein the compound capable of complexing with borate is an o-aromatic hydroxy acid.

6. The lotion and wet web combination of claim 1 wherein the compound capable of complexing with borate is a alicyclic α-hydroxy acid or salt thereof.

7. A non-woven, adhesively bonded web having a majority of wood pulp fibers of a paper making length;

said web wet with a water based lotion, having a tensile strength of at least 4 oz./in. while wet with the lotion, maintaining said tensile strength while wet with the lotion for a period of at least one month and substantially losing the wet tensile strength when immersed in a volume of water at least 10 times the weight of the web, wherein said wet tensile strength is obtained with an adhesive composition which obtains at least part of its adhesive properties by interaction with borate ions in said lotion, said adhesive composition containing;

from about 5 to about 15 parts of a cold water soluble polyvinyl alcohol having a degree of hydrolysis of from about 70% to about 90% and a degree of polymerization of at least 450;

from about 1.5 to about 2.5 parts of a non-self-cross-linking, water dispersible, polymer capable of functioning as a fiber adhesive, having a molecular weight of at least 100,000, and a glass transition temperature at which an air-dried film of the polymer solids has a torsional modulus of 300 kg./cm.$^2$ of from about −50° C. to about +45° C.;

from about 0.75 to about 1.25 parts of a water dispersible, self-cross-linking, polymer capable of functioning as a fiber adhesive, having a molecular weight of at least 100,000, and a glass transition temperature at which an air-dried film of polymer solids has a torsional modulus of 300 kg./cm.$^2$ of from about −50° C. to about +45° C.;

said lotion being a water solution containing an active amount of borate ions for forming a gel with the polyvinyl alcohol component of the adhesive;

said web being wet with an amount of said lotion equal to at least 100% of the weight of the web.

8. The lotion and wet web combination of claim 7 wherein the non-cross-linking polymer is a polyacrylate polymer.

9. The lotion and wet web combination of claim 7 wherein the self-cross-linking polymer is a polyacrylate polymer having a glass transition temperature of from about −46° C. to +33° C. and containing a reactive moiety for cross-linking selected from the group consisting of carboxyl and methylol amine.

10. The lotion and wet web combination of claim 7 wherein the web is a dry formed web and the non-self-cross-linking polymer is a polyacrylate having a glass transition temperature in the range of from −46° C. to +30° C. for an air-dry film of the polymer solids, and said self-cross-linking polymer is a polyacrylate having a glass transition temperature for an air-dried film of the polymer solids from −22° C. to +33° C.

11. The lotion and wet web combination of claim 7 wherein the non-self-cross-linking polymer is an ethylene vinylacetate polymer.

12. The lotion and wet web combination of claim 7 wherein the self-cross-linkable polymer is an ethylene vinylacetate polymer emulsion.

13. The lotion and wet web combination of claim 7 wherein the lotion contains from about 0.5% to about 1.5% boric acid and is buffered to have a pH in the range of from about 8 to 10.

14. The lotion and wet web combination of claim 7 wherein the combination is in a package containing the web wet with from about 200% to about 800% lotion based upon the air-dry weight of the web.

15. The lotion and web combination of claim 14 wherein the web is a dry formed web containing at least about 80% wood pulp fibers.

16. A nonwoven, adhesively bonded web wet with a lotion, said wet web having a tensile strength of at least 4.0 oz./in., said adhesive bonding being provided by an adhesive composition which obtains at least part of its adhesive properties by interaction with borate ions in said lotion;

said adhesive composition containing from about 5 to about 15 parts of a cold water soluble polyvinyl alcohol having a degree of hydrolysis of from about 70% to about 90% and a degree of polymerization of at least 450;

from about 1.5 to about 2.5 parts of a non-self-cross-linking, water dispersible, polymer capable of functioning as a fiber adhesive, having a molecular weight of at least 100,000, and a glass transition temperature at which an air-dried film of the polymer solids has a torsional modulus of 300 kg./cm.$^2$ of from about −50° C. to about +45° C.;

from about 0.75 to about 1.25 parts of a water dispersible, self-cross-linkable, polymer capable of functioning as a fiber adhesive, having a molecular weight of at least 100,000, and a glass transition temperature at which an air-dried film of polymer solids has a torsional modulus of 300 kg./cm.$^2$ of from about −50° C. to about +45° C.;

said lotion being a water solution containing an active amount of borate ions for forming a gel with the polyvinyl alcohol component of the adhesive;

said web being wet with an amount of said lotion equal to at least 100% of the weight of the web;

wherein the lotion contains a compound capable of forming a complex with borate and the molar ratio of borate to said compound being from 0.1:1 to 1.6:1.

17. The lotion and wet web combination of claim 16 wherein the web is a dry formed web and the non-self-cross-linking polymer is a polyacrylate having a glass transition temperature in the range of from −46° C. to +30° C. for an air-dry film of the polymer solids, and said self-cross-linking polymer is a polyacrylate having a glass transition temperature for an air-dried film of the polymer solids from −22° C. to +33° C.

18. The lotion and wet web combination of claim 16 wherein the lotion contains from about 0.5% to about 1.5% boric acid and is buffered to have a pH in the range of from about 8 to 10.

19. The lotion and wet web combination of claim 16 wherein the combination is in a package containing the web wet with from about 100% to about 600% lotion based upon the air-dry weight of the web.

20. The lotion and wet web combination of claim 16 wherein the compound capable of complexing with borate is an α-hydroxy organic acid or a salt thereof.

21. The lotion and wet web combination of claim 16 wherein the α-hydroxy acid or salt thereof is citric acid or potassium citrate.

* * * * *